US012292044B2

(12) United States Patent
Ueno et al.

(10) Patent No.: US 12,292,044 B2
(45) Date of Patent: May 6, 2025

(54) ROTARY COMPRESSOR AND AIR CONDITIONER

(71) Applicant: DAIKIN INDUSTRIES, LTD., Osaka (JP)

(72) Inventors: Hiromichi Ueno, Osaka (JP); Tatsuya Katayama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/811,274

(22) Filed: Aug. 21, 2024

(65) Prior Publication Data

US 2024/0410349 A1 Dec. 12, 2024

Related U.S. Application Data

(63) Continuation of application No. PCT/JP2023/005009, filed on Feb. 14, 2023.

(30) Foreign Application Priority Data

Mar. 24, 2022 (JP) ..... 2022-048468

(51) Int. Cl.
*F25B 31/02* (2006.01)
*F04B 35/04* (2006.01)
*F04B 49/20* (2006.01)

(52) U.S. Cl.
CPC ..... *F04B 35/04* (2013.01); *F04B 49/20* (2013.01); *F25B 31/026* (2013.01)

(58) Field of Classification Search
CPC ..... F04C 29/02; F04C 29/00; F04C 29/0085; F04C 23/008; F04B 39/04; F04B 39/12; Y10S 417/902
See application file for complete search history.

(56) References Cited

U.S. PATENT DOCUMENTS 6,075,304 A * 6/2000 Nakatsuka ..... H02K 3/38 310/43
6,102,677 A * 8/2000 Iida ..... F04C 18/10 417/463

(Continued)

FOREIGN PATENT DOCUMENTS

JP 3670890 B2 4/2005

OTHER PUBLICATIONS

International Search Report of corresponding PCT Application No. PCT/JP2023/005009 dated Apr. 18, 2023.

(Continued)

*Primary Examiner* — Frantz F Jules
*Assistant Examiner* — Martha Tadesse
(74) *Attorney, Agent, or Firm* — GLOBAL IP COUNSELORS, LLP

(57) ABSTRACT

A rotary compressor includes a cylindrical casing, an electric motor, and a compression mechanism. The cylindrical casing has first and second end plates ends in an axial direction. The electric motor is a variable-speed electric motor. The electric motor is disposed in the casing in which a first space is sandwiched between the electric motor and the first end plate. The compression mechanism is disposed in the casing in which a second space is sandwiched between the compression mechanism and the electric motor. The compression mechanism is coupled with the electric motor. The rotational compressor satisfies $0.8 \leq (A+B)*D^2/(Vcc*Nmax) \leq 1.0$. An axial length of the first space is A, an axial length of the second space is B, an inner diameter of the casing is D, a suction volume per rotation of the compression mechanism is Vcc, and a maximum rotational speed of the compression mechanism is Nmax.

11 Claims, 3 Drawing Sheets

(56) References Cited

U.S. PATENT DOCUMENTS

| | | | | |
|---|---|---|---|---|
| 6,533,558 | B1 * | 3/2003 | Matsumoto | H02K 1/146 417/410.3 |
| 7,377,755 | B2 * | 5/2008 | Cho | F01C 21/108 417/252 |
| 8,616,016 | B2 * | 12/2013 | Asano | H02K 21/24 62/238.7 |
| 2009/0293534 | A1 * | 12/2009 | Tanaka | F04C 29/026 62/470 |

OTHER PUBLICATIONS

International Preliminary Report of corresponding PCT Application No. PCT/JP2023/005009 dated Oct. 3, 2024.

* cited by examiner

| (A+B) × D^2/(Vcc × Nmax) | 0.724 | 0.77 | 0.8 | 0.926 | 1 | 1.2 |
|---|---|---|---|---|---|---|
| RATE OF OIL LOSS (wt%) | 1.58 | 1.16 | 0.91 | 0.42 | 0.35 | 0.25 |

| (A+B) × D^2/(Vcc × Nmax) | 0.770 | 0.800 | 0.926 | 0.990 | 1.000 |
|---|---|---|---|---|---|
| VIBRATION (μm) | 27.0 | 27.5 | 29.2 | 29.9 | 30.0 |

ROTARY COMPRESSOR AND AIR CONDITIONER

CROSS-REFERENCE TO RELATED APPLICATIONS

This is a continuation of International Application No. PCT/JP2023/005009 filed on Feb. 14, 2023, which claims priority to Japanese Patent Application No. 2022-048468, filed on Mar. 24, 2022. The entire disclosures of these applications are incorporated by reference herein.

BACKGROUND

Technical Field

The present disclosure relates to a rotary type compressor and an air conditioner.

Background Art

In general, a rotary type compressor includes a cylindrical casing closed at both ends and housing an electric motor and a compression mechanism, where the compression mechanism is driven by the electric motor (see, e.g., Japanese Patent No. 3670890).

The compressor of Japanese Patent No. 3670890 uses a concentrated winding electric motor in order to reduce the size of a coil and to ensure a space for separating lubricant oil from a refrigerant in the casing. This compressor satisfies a relationship represented by $0.3 \leq L1/(L1+L2) \leq 0.6$ between the height (L1) of a space in the casing above the electric motor and the height (L2) of the electric motor (the height from the upper end to the lower end of the coil), thereby reducing upsizing of the casing.

SUMMARY

A first aspect of the present disclosure is directed to rotary compressor including a cylindrical casing, an electric motor, and a compression mechanism. The cylindrical casing has a first end plate at one end in an axial direction and a second end plate at an other end in the axial direction. The electric motor is a variable-speed electric motor. The electric motor is disposed in the casing in which a first space is sandwiched between the electric motor and the first end plate. The compression mechanism is disposed in the casing in which a second space is sandwiched between the compression mechanism and the electric motor. The compression mechanism is coupled with the electric motor. The rotational compressor satisfies $0.8 \leq (A+B)*D^2/(Vcc*Nmax) \leq 1.0$. An axial length of the first space is A, an axial length of the second space is B, an inner diameter of the casing is D, a suction volume per rotation of the compression mechanism is Vcc, and a maximum rotational speed of the compression mechanism is Nmax).

DETAILED DESCRIPTION OF EMBODIMENT(S)

First Embodiment

An embodiment will be described below in detail with reference to the drawings.

Figure 1:
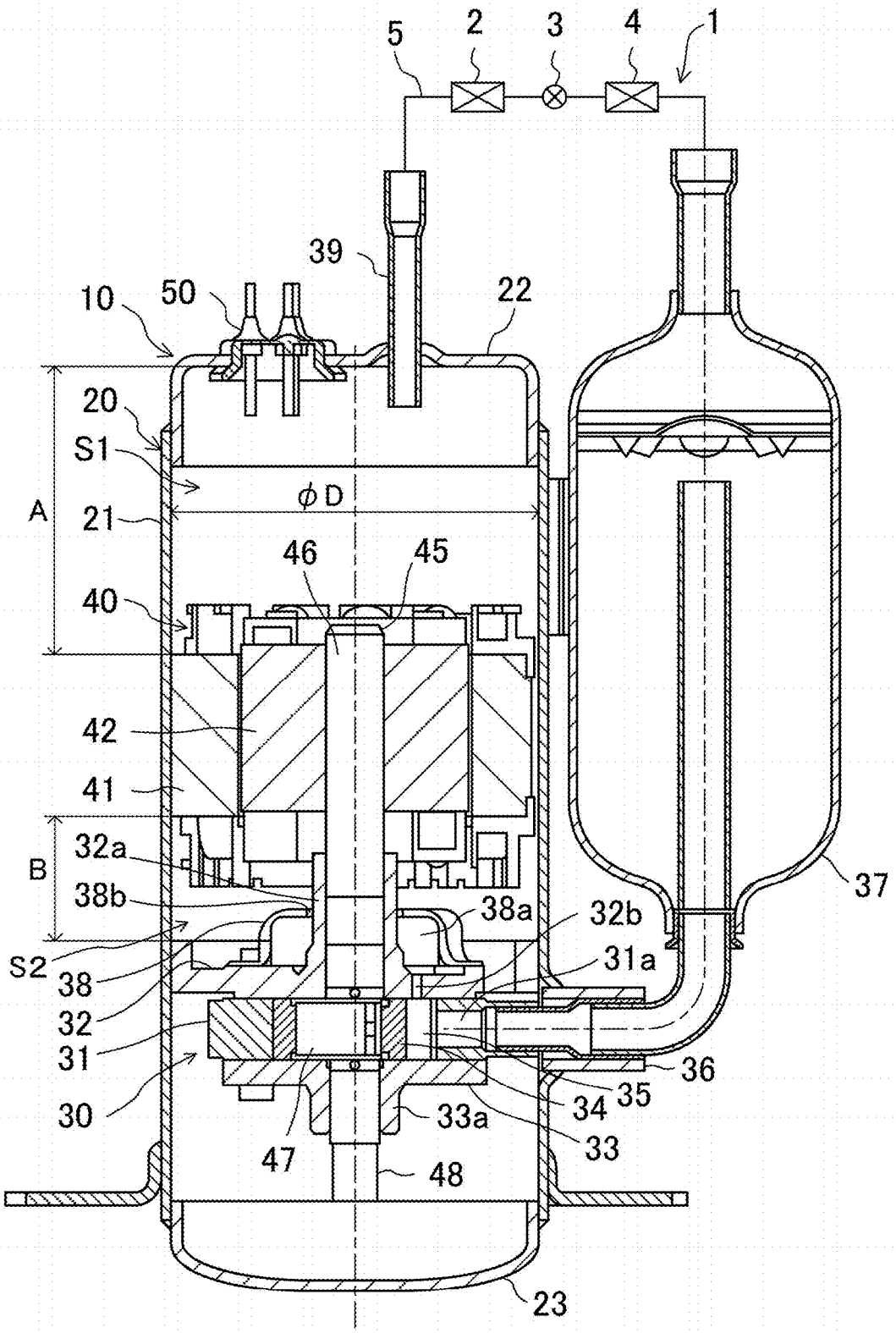
FIG. 1 is a sectional view of a rotary type compressor of an embodiment.

A rotary type compressor (hereinafter simply referred to as a compressor) (10) of this embodiment is an oscillating piston compressor (10), and is connected to a refrigerant circuit (1) as shown in FIG. 1. The refrigerant circuit (1) includes the compressor (10), a radiator (2), an expansion mechanism (3), and an evaporator (4) connected in sequence via a refrigerant pipe (5), and performs a vapor compression refrigeration cycle by a refrigerant circulating therein. In general, as the expansion mechanism (3), an expansion valve whose opening degree is adjustable is used, but another component such as a capillary tube whose opening degree is fixed may be used.

The compressor (10) includes a casing (20). The casing (20) is a closed container having a vertically long cylindrical shape and including a first end plate (22) at one end (upper end) and a second end plate (23) at the other end (lower end) of a cylindrical barrel (21) in the axial direction. The casing (20) houses a compression mechanism (30) that compresses a refrigerant in the refrigerant circuit (1) and an electric motor (40) that is a variable-speed type electric motor and that drives the compression mechanism (30), where compression mechanism (30) and the electric motor (40) are fixed to the inner peripheral surface of the barrel (21). The electric motor (40) is disposed in the casing (20) in which a first space (S1) is sandwiched between the electric motor (40) and the first end plate (22), and the compression mechanism (30) is disposed in the casing (20) in which a second space (S2) is sandwiched between the compression mechanism (30) and the electric motor (40).

The electric motor (40) includes a stator (41) and a rotor (42), both formed in a cylindrical shape. The stator (41) is fixed to the barrel (21) of the casing (20). The stator (41) includes a hollow portion where the rotor (42) is disposed. A drive shaft (45) is fixed to a hollow portion of the rotor (42) so as to penetrate the rotor (42), and that the rotor (42) and the drive shaft (45) rotates integrally.

The drive shaft (45) includes a main shaft portion (46) extending vertically. The drive shaft (45) is formed integrally with an eccentric portion (47) near a lower end of the main shaft portion (46). The eccentric portion (47) has a larger diameter than the main shaft portion (46). The eccentric portion (47) has an axis decentered by a predetermined distance with respect to the axis of the main shaft portion (46).

A lower end portion of the main shaft portion (46) is provided with an oil supply pump (48). The oil supply pump (48) is immersed in lubricant oil in an oil reservoir formed at the bottom of the casing (20). The oil supply pump (48) pumps up lubricant oil into an oil supply path (not shown) in the drive shaft (45) along with rotation of the drive shaft (45), and then supplies the lubricant oil to each sliding portion of the compression mechanism (30).

The compression mechanism (30) includes a cylinder (31) formed in an annular shape. The cylinder (31) has one axial end (upper end) to which a front head (32) is fixed and the other axial end (lower end) to which a rear head (33) is fixed. The cylinder (31), the front head (32), and the rear head (33) are stacked from top to bottom in order of the front head (32), the cylinder (31), and the rear head (33), and are fastened and fixed together with a plurality of bolts, for example.

The drive shaft (45) vertically penetrates the compression mechanism (30). The front head (32) and the rear head (33) are provided with bearing portions (32*a*, 33*a*) that support the drive shaft (45) at both above and below the eccentric portion (47).

The cylinder (31) has an upper end closed by the front head (32) and a lower end closed by the rear head (33). The internal space of the cylinder (31) forms a cylinder chamber (35). The cylinder (31) (cylinder chamber (35)) houses a tubular piston (34) slidably fitted to the eccentric portion (47) of the drive shaft (45). As the drive shaft (45) rotates, the piston (34) rotates eccentrically in the cylinder chamber (35). Although not shown in the figure, the piston (34) has an outer peripheral surface integrated with a blade extending radially outward from the outer peripheral surface of the piston (34). The blade is held by a bush (not shown) provided in the piston (34) and swings along with rotation of the drive shaft (45). Thus, the piston (34) being rotated by itself is restricted.

The cylinder (31) has a suction port (31*a*) communicating with the cylinder chamber (35). The suction port (31*a*) is connected with a suction pipe (36) fixed to the barrel (21). The suction pipe (36) is connected with an accumulator (37) fixed to the casing (20).

The front head (32) has a discharge port (32*b*) extending parallel to the axis of the drive shaft (45). The discharge port (32*b*) is opened and closed by a discharge valve (not shown). A muffler (38) is attached to an upper surface of the front head (32) so as to cover the discharge port (32*b*) and the discharge valve. A muffler space (38*a*) defined in the muffler (38) communicates with the internal space of the casing (20) through a discharge opening (38*b*) formed on an upper portion of the muffler (38).

As described above, the suction pipe (36) connected to the suction port (31*a*) is attached to the casing (20) so that a refrigerant is sucked into the compression mechanism (30) through the accumulator (37) and the suction pipe (36).

A discharge pipe (39) is attached to the casing (20) and penetrates the first end plate (22). A lower end portion of the discharge pipe (39) is open to the inside of the casing (20). The discharge port (32*b*) of the compression mechanism (30) communicates with the internal space of the casing (20) through the discharge opening (38*b*) of the muffler (38). A refrigerant discharged from the compression mechanism (30) flows out of the casing (20) through the internal space of the casing (20) and the discharge pipe (39).

The first end plate (22) of the casing (20) is provided with a terminal (50) to which an electric wire for supplying electric power to the electric motor (40) is connected.

The compressor of this embodiment satisfies a relationship represented by $0.8 \leq (A+B)*D^2/(Vcc*Nmax) \leq 1.0$, where the axial length of the first space (S1) is A (mm), the axial length of the second space (S2) is B (mm), the inner diameter of the casing (20) is D (mm), the suction volume per rotation of the compression mechanism (30) is Vcc ($mm^3$), and the maximum rotational speed of the compression mechanism (30) is Nmax (rps).

According to this embodiment, $D<100$, $Nmax \geq 118$, and $6\times10^3 \leq Vcc \leq 8\times10^3$. The values A and B are determined as appropriate (for example, the value A may be about 50 to 70 mm, and the value B may be about 20 to 30 mm).

Figures 2A, 2B:
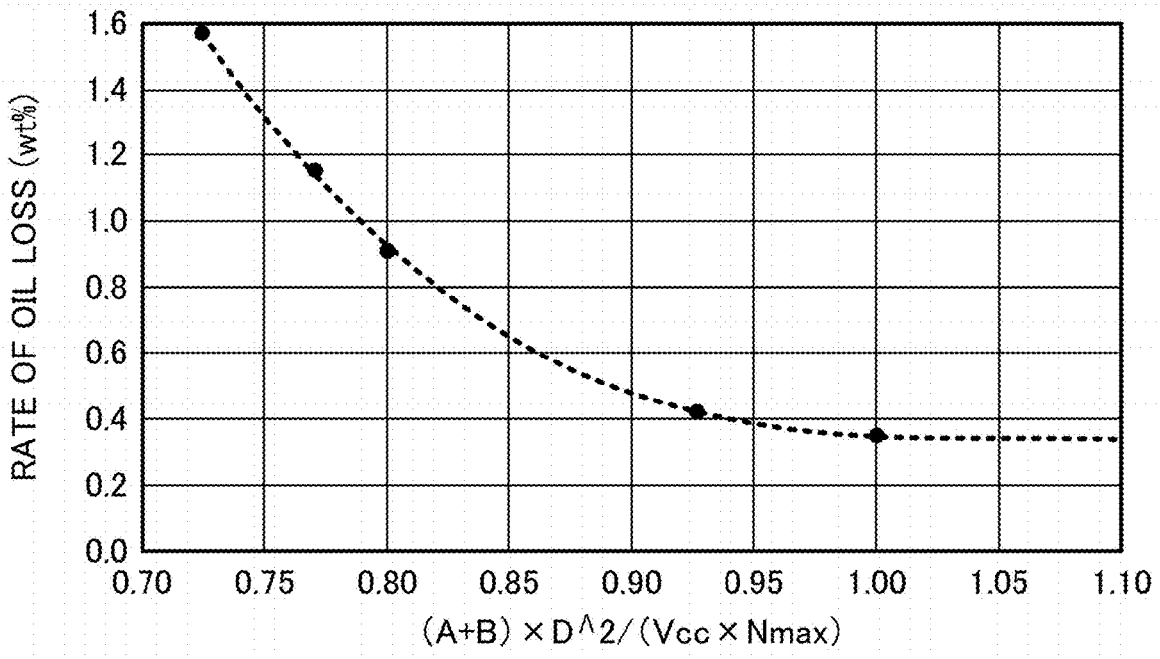
FIG. 2A is a table showing a relationship between a volume ratio represented by $(A+B)*D^2/(Vcc*Nmax)$ (a ratio between the spatial volume in a casing and the suction volume of the compressor at the maximum number of rotations) and a rotate of oil loss.
FIG. 2B is a graph showing of the relationship between the volume ratio represented by $(A+B)*D^2/(Vcc*Nmax)$ and the rate of oil loss.

A relationship under those conditions between a volume ratio represented by $(A+B)*D^2/(Vcc*Nmax)$ (a ratio between a spatial volume in the casing and the suction volume of the compressor (10) at the maximum number of rotations) and a rate of oil loss at a plurality of points where the volume ratio ranges from about 0.70 to 1.20 is shown in the table of FIG. 2A and the graph of FIG. 2B. Further, a relationship under the same conditions between the volume ratio and a vibration amount (the amount of vibration of the casing (20)) at a plurality of points where the volume ratio ranges from about 0.70 to 1.10 is shown in the table of FIG. 3A and the graph of FIG. 3B.

The rate of oil loss is a ratio between the total amount of oil and the amount of oil having flowed out of the casing (20). As the volume ratio decreases, i.e., as the spatial volume in the casing (20) with respect to the suction volume at the maximum number of rotations decreases, the rate of oil loss increases and the amount of oil flowing out of the casing (20) increases. As the volume ratio increases, i.e., as the spatial volume in the casing (20) with respect to the suction volume Vcc at the maximum number Nmax of rotations increases, the rate of oil loss decreases and the amount of oil flowing out of the casing (20) decreases.

According to this embodiment, the volume ratio satisfies the relationship represented by $0.8 \leq (A+B)*D^2/(Vcc*Nmax) \leq 1.0$, and the rate of oil loss ranges between 0.91 to 0.35 as shown in FIGS. 2A and 2B. If the volume ratio is smaller than 0.8, the rate of oil loss is higher, but according to this embodiment, an increase in the rate of oil loss can be reduced. If the volume ratio is larger than 1.0, the rate of oil loss is substantially constant, and thus the spatial volume in the casing (20) does not need to be excessively large and upsizing of the casing (20) can be reduced.

Figures 3A, 3B:
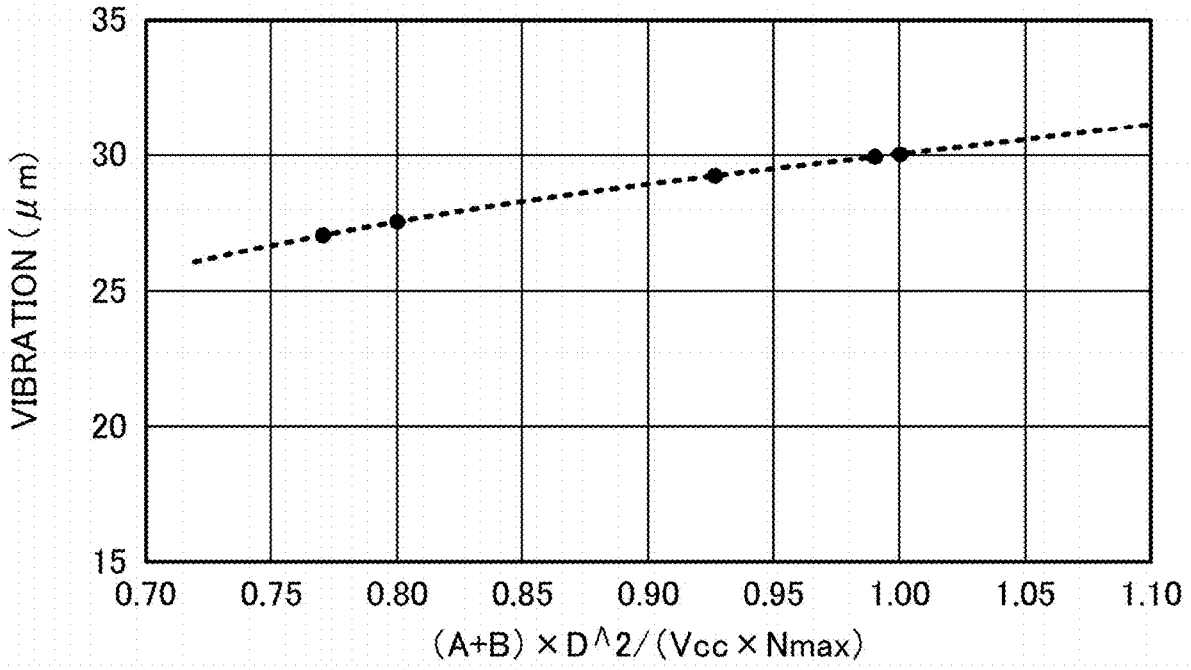
FIG. 3A is a table showing a relationship between the volume ratio represented by $(A+B)*D^2/(Vcc*Nmax)$ and the value of vibration of the compressor.
FIG. 3B is a graph showing the relationship between the volume ratio represented by $(A+B)*D^2/(Vcc*Nmax)$ and the value of vibration of the compressor.

The volume ratio satisfies the relationship represented by $0.8 \leq (A+B)*D^2/(Vcc*Nmax) \leq 1.0$, and the vibration amount (μm) of the casing (20) ranges from 27.5 to 30 (μm) as shown in FIGS. 3A and 3B. If the volume ratio is smaller than 0.8, the vibration amount is smaller while the rate of oil loss is higher, but according to this embodiment, both the vibration amount and the rate of oil loss are reduced. Further, if the volume ratio is larger than 1.0, the vibration amount is larger, but according to this embodiment, the vibration amount can be reduced while the rate of oil loss is reduced.

Advantages of Embodiment

If a conventional compressor has a barrel with a smaller diameter for downsizing and operates at a higher rotational speed to ensure an appropriate amount of discharge, an average gas flow velocity directing upward from a compression mechanism to a discharge pipe increases. Accordingly, the oil separation effect in a space in a casing decreases, and the amount of oil loss increases. If the spatial volume in the casing is made larger to deal with the problem, the compressor is upsized.

According to this embodiment, the volume ratio is set to $0.8 \leq (A+B)*D^2/(Vcc*Nmax) \leq 1.0$. As described above, according to this embodiment, not only the spatial volume in the casing (20) is increased so that the rate of oil loss is reduced, but also the range of the volume ratio is determined so that the vibration amount is reduced. In particular, the height of the casing (20) of the compressor (10) is reduced so that downsizing can be achieved, and also the height of the casing (20) is reduced so that even when the compressor (10) operates at a high speed, an increase in the rate of oil loss can be reduced while the vibration can be reduced.

According to this embodiment, vibration of the compressor (10) is reduced, and thus damage to the casing (20) and the pipe due to the vibration can be reduced. Further, the rate of oil loss is reduced, and thus decrease in the reliability of the sliding portion of the compressor (10) can be reduced.

According to this embodiment, the relationships represented by $D<100$ and $Nmax\geq118$ are satisfied. According to this embodiment, the compressor (10) includes the casing (20) with a smaller diameter and operates at a high speed, where an increase in the rate of oil loss can be reduced while the vibration of the casing (20) can be reduced.

According to this embodiment, the relationship represented by $6\times10^3\leq Vcc\leq8\times10^3$ is satisfied. According to this embodiment, the compressor has a small capacity, where an increase in the rate of oil loss can be reduced while the vibration of the casing (20) can be reduced.

According to an air conditioner including the compressor of this embodiment, the rate of oil loss of the compressor (10) is reduced, thereby reducing lubricant oil adhering to the heat exchangers (2, 4) of the refrigerant circuit and inhibiting heat transfer. Thus, a decrease in the system efficiency can also be reduced.

Other Embodiments

The above embodiment may be modified as follows.

First Variation

In the above embodiment, the volume ratio may be set to a range of $0.85\leq(A+B)*D^2/(Vcc*Nmax)\leq0.95$.

Accordingly, the range of the volume ratio is limited to a range narrower than that of the above embodiment. Thus, the rate of oil loss can be further reduced than according to the above embodiment. Then, upsizing of the casing (20) can be further reduced and the vibration amount can also be reduced. As a result, damage to the casing (20) and the pipe, a decrease in the reliability of the compressor (10), and a reduction in the system efficiency can be further reduced.

Second Variation

In the above embodiment, the volume ratio may be set to a range of $0.9\leq(A+B)*D\hat{}2/(Vcc*Nmax)\leq1.0$.

Accordingly, the rate of oil loss can be further reduced than according to the above embodiment and the first variation, and upsizing of the casing (20) can be reduced as easily as according to the embodiment and the first variation. Thus, the vibration amount can be reduced. As a result, a decrease in the reliability of the compressor (10) and a reduction in the system efficiency can be further reduced while damage to the casing (20) and the pipe can be reduced.

While the embodiment and variations thereof have been described above, it will be understood that various changes in form and details may be made without departing from the spirit and scope of the claims. The elements according to the embodiments, the variations thereof, and the other embodiments may be combined and replaced with each other.

As described above, the present disclosure is useful for a rotary type compressor and an air conditioner.

The invention claimed is:

1. A rotary compressor comprising:

a cylindrical casing having a first end plate at one end in an axial direction and a second end plate at an other end in the axial direction;

an electric motor that is a variable-speed electric motor, the electric motor being disposed in the cylindrical casing in which a first space is sandwiched between the electric motor and the first end plate; and a compression mechanism disposed in the cylindrical casing in which a second space is sandwiched between the compression mechanism and the electric motor, the compression mechanism being coupled with the electric motor, the rotary compressor satisfies $0.8\leq(A+B)*D^2/(Vcc*Nmax)\leq1.0$, where an axial length of the first space is A, an axial length of the second space is B, an inner diameter of the cylindrical casing is D, a suction volume per rotation of the compression mechanism is Vcc, and a maximum rotational speed of the compression mechanism is Nmax).

2. The rotary compressor of claim 1, wherein $D<100$ and $Nmax\geq118$.

3. The rotary compressor of claim 1, wherein $0.85\leq(A+B)*D^2/(Vcc*Nmax)\leq0.95$.

4. The rotary compressor of claim 1, wherein $6\times10^3\leq Vcc\leq8\times10^3$.

5. An air conditioner including the rotary compressor of claim 1, the air conditioner further comprising:

a refrigerant circuit of a vapor compression refrigeration cycle, a compressor of the refrigerant circuit being the rotary compressor.

6. The rotary compressor of claim 2, wherein $0.85\leq(A+B)*D^2/(Vcc*Nmax)\leq0.95$.

7. The rotary compressor of claim 2, wherein $6\times10^3\leq Vcc\leq8\times10^3$.

8. The rotary compressor of claim 3, wherein $6\times10^3\leq Vcc\leq8\times10^3$.

9. An air conditioner including the rotary compressor of claim 2, the air conditioner further comprising:

a refrigerant circuit of a vapor compression refrigeration cycle, a compressor of the refrigerant circuit being the rotary compressor.

10. An air conditioner including the rotary compressor of claim 3, the air conditioner further comprising:

a refrigerant circuit of a vapor compression refrigeration cycle, a compressor of the refrigerant circuit being the rotary compressor.

11. An air conditioner including the rotary compressor of claim 4, the air conditioner further comprising:

a refrigerant circuit of a vapor compression refrigeration cycle, a compressor of the refrigerant circuit being the rotary compressor.

* * * * *